US008080701B2

(12) United States Patent
Nagel Voort et al.

(10) Patent No.: US 8,080,701 B2
(45) Date of Patent: Dec. 20, 2011

(54) METHOD AND APPARATUS FOR TREATING A HYDROCARBON STREAM

(75) Inventors: Robert Klein Nagel Voort, The Hague (NL); Wouter Jan Meiring, Kuala Lumpur (MY)

(73) Assignee: Shell Oil Company, Houston, TX (US)

( * ) Notice: Subject to any disclaimer, the term of this patent is extended or adjusted under 35 U.S.C. 154(b) by 478 days.

(21) Appl. No.: 12/303,483

(22) PCT Filed: Jun. 4, 2007

(86) PCT No.: PCT/EP2007/055436

§ 371 (c)(1),
(2), (4) Date: Dec. 4, 2008

(87) PCT Pub. No.: WO2007/141227

PCT Pub. Date: Dec. 13, 2007

(65) Prior Publication Data

US 2009/0194460 A1 Aug. 6, 2009

(30) Foreign Application Priority Data

Jun. 6, 2006 (EP) ..... 06114989

(51) Int. Cl.
*C10G 33/00* (2006.01)

(52) U.S. Cl. ..... 585/802; 585/800; 585/899; 62/600; 62/618; 62/620; 62/630

(58) Field of Classification Search ..... 62/600, 62/618, 620, 630; 585/800, 802, 899
See application file for complete search history.

(56) References Cited

U.S. PATENT DOCUMENTS

| | | | | |
|---|---|---|---|---|
| 4,012,212 | A | 3/1977 | Kniel | 62/28 |
| 5,035,732 | A * | 7/1991 | McCue, Jr. | 62/627 |
| 5,502,266 | A | 3/1996 | Hodson | 585/802 |
| 2002/0088249 | A1 | 7/2002 | Minta et al. | 62/612 |
| 2004/0238412 | A1 | 12/2004 | Runbalk | 208/340 |
| 2005/0217314 | A1 | 10/2005 | Baudat | 62/613 |

FOREIGN PATENT DOCUMENTS

| | | |
|---|---|---|
| GB | 2224036 | 4/1990 |
| GB | 2229519 | 9/1990 |
| WO | WO2006049515 | 5/2006 |

* cited by examiner

*Primary Examiner* — Walter D Griffin
*Assistant Examiner* — Brian McCaig

(57) ABSTRACT

A method of treating a hydrocarbon stream such as natural gas comprising at least the steps of: (a) providing a hydrocarbon feed stream (10); (b) passing the feed stream (10) through a first separation vessel (12) to provide a first gaseous stream (20) and a first liquid stream (30); (c) passing the first gaseous stream (20) from step (b) through a high pressure separation vessel (14) to provide a second gaseous stream (40) and a second liquid stream (80); (d) maintaining the pressure of the first gaseous stream (20) between step (b) and step (c) within +10 bar; (e) passing the first liquid stream (30) of step (b) through a stabilizer column (16) to provide a third gaseous stream (60) and a stabilized condensate (70); and (f) feeding the second liquid stream (80) from step (c) into the stabilizer column (16).

19 Claims, 1 Drawing Sheet

METHOD AND APPARATUS FOR TREATING A HYDROCARBON STREAM

Figure 1:
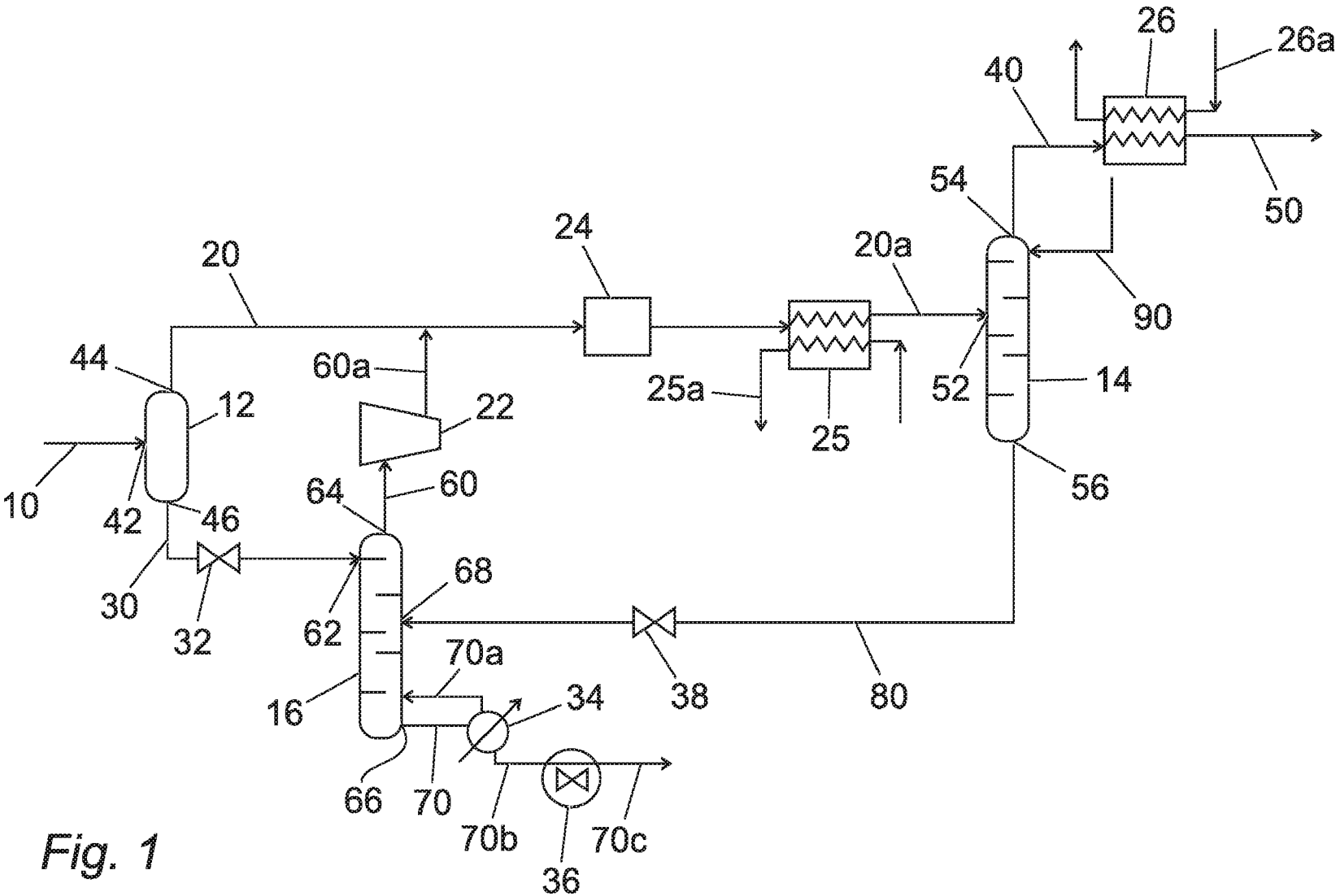

The present invention relates to a method and apparatus for treating a hydrocarbon stream such as natural gas.

Several methods of liquefying a natural gas stream thereby obtaining liquefied natural gas (LNG) are known.

It is desirable to liquefy a natural gas stream for a number of reasons. As an example, natural gas can be stored and transported over long distances more readily as a liquid than in gaseous form, because it occupies a smaller volume and does not need to be stored at high pressures.

U.S. Pat. No. 4,012,212 describes a process for the liquefaction of natural gas including heavier hydrocarbons such as ethane, propane, butane and the like. Components heavier than the $C_4$ fraction are a major problem in any liquefaction system, since such components freeze at the low temperatures thereby fouling the liquefaction equipment. U.S. Pat. No. 4,012,212 describes introducing an expanded natural gas stream into a fractionating zone to remove as a liquid a $C_5$+ hydrocarbon stream. The liquid hydrocarbon stream therefrom is introduced into a refluxed debutanizer column from which one product is used for fuel and another to provide reflux for the column.

It is an object of the present invention to improve the efficiency of separating natural gas into different constituents.

It is another object of the present of the present invention to reduce the capital and/or running costs for a liquefaction plant.

It is another object of the present invention to improve the quality and/or quantity of natural gas, i.e. methane, to be liquefied by a liquefaction plant.

One or more of the above or other objects can be achieved by the present invention providing a method of treating a hydrocarbon stream such as natural gas comprising at least the steps of:

(a) providing a hydrocarbon feed stream;
(b) passing the feed stream through a first separation vessel to provide a first gaseous stream and a first liquid stream;
(c) passing the first gaseous stream from step (b) through a high pressure separation vessel to provide a second gaseous stream and a second liquid stream;
(d) maintaining the pressure of the first gaseous stream (20) between step (b) and step (c) within ±10 bar;
(e) passing the first liquid stream of step (b) through a stabilizer column to provide a third gaseous stream and a stabilized condensate; and
(f) feeding the second liquid stream from step (c) into the stabilizer column.

An advantage of the present invention is that the interconnection of the first separation vessel, high pressure separation vessel and the stabilizer column improves the efficiency of the separation of the hydrocarbon stream such as natural gas into a gaseous stream which is suitable for liquefying into liquid natural gas, and other components.

Another advantage of the present invention is that a separate separation of the second liquid stream, created by the high pressure separation vessel, is not required, reducing the capital and running costs of the liquefaction plant.

Another advantage is increased $C_5$+ recovery because there is no pentane slip in any separate column (such as a debutanizer), which has hitherto been used for the separate separation of the second liquid stream.

The hydrocarbon stream to be treated may be any suitable gas stream, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the feed stream comprises at least 60 mol % methane, more preferably at least 80 mol % methane.

Depending on the source, the natural gas may contain varying amounts of hydrocarbons heavier than methane such as ethane, propane, butanes and pentanes as well as some aromatic hydrocarbons. Hydrocarbons heavier than methane generally need to be removed from natural gas for several reasons, such as having different freezing or liquefaction temperatures that may cause them to block parts of a methane liquefaction plant. $C_{2-4}$ hydrocarbons can be used as a source of natural gas liquids.

A natural gas stream may also contain non-hydrocarbons such as $H_2O$, $N_2$, $CO_2$, $H_2S$ and other sulphur compounds, and the like. If desired, the feed stream containing the natural gas may be pre-treated before feeding it to the first separation vessel. This pre-treatment may comprise removal of undesired components such as $CO_2$ and $H_2S$, or other steps such as pre-cooling, pre-pressurizing or the like. As these steps are well known to the person skilled in the art, they are not further discussed here.

Generally, the three main gas/liquid separators involved in the present invention may be any column or arrangement adapted to separate an input stream into at least one gaseous stream and at least one liquid stream. Two or more gaseous streams and/or liquid streams may be created. Generally, a gaseous stream will be methane-enriched, and a liquid stream will be heavier hydrocarbon enriched. At least part of one or more of the liquid streams provided by the present invention may be used to produce a natural gas liquid product or products.

Suitable separators include known gas/liquid separators, fractionators, distillation columns and scrub columns.

The high pressure separation vessel is preferably a distillation column operating at a pressure >40 bar, preferably in the range 45-70 bar. High pressure separators are known in the art.

The stabilizer column for the first and second liquid streams may be any form of column having a temperature grading between its top and bottom. Stabilizing columns usually have some form of heating or heat input at or near the bottom or base, such as a re-boiler.

Preferably, the stabilized condensate provided by the stabilizing column comprises >85 mol %, more preferably >90 mol %, >95 mol % or even >99 mol %, $C_4$+ hydrocarbons.

The pressure of the first gaseous stream is maintained between steps (b) and (c) within ±10 bar, optionally within ±5 bar. That is, there is not intended to be any significant change in pressure of the first gaseous stream between the first separation vessel and the high pressure separation vessel, which significant pressure changes are usually created by one or more in-line compressors, valves or expanders.

The maintenance of the first gaseous stream pressure is in contrast to prior art separation systems having at least one (usually multiple) pressure changes between separators using one or more compressors and/or expanders. For example, U.S. Pat. No. 5,502,266 shows a method of separating well fluids involving compression and expansion changes between its various separators. Significant changes in pressure require the input of work energy (as well as the addition of equipment such as compressors and expanders).

The present invention significantly simplifies operation between the first separation vessel and the high pressure separation vessel, reducing capital and running costs, in particular the total energy requirement for treating a hydrocarbon stream between a feed stream and a purified hydrocarbon stream ready for cooling and/or liquefying.

The stabilized condensate will generally be a $C_4$ and $C_5$+ (i.e. butanes, pentanes, etc) stream, having a vapour pressure less than 1 bar at ambient pressure and temperature, such as 25° C. Thus, the stabilizer column preferably generally operates at a low pressure, for example in the range 1-20 bar, and low in comparison with the pressure of the high pressure separation vessel providing the second gaseous and liquid streams. Where the stabilizer column involves a re-boiler at or near its bottom or base, the re-boiler will generally involve a recycle stream of about equal to that of the stabilized condensate product stream, which recycle stream will generally be of a majority $C_4/C_5$ composition. Thus, there may be a final product stream that can be provided from the stabilizer column being >85 mol %, or >90 mol %, more preferably >95 mol % or even >99 mol %, $C_5$+ hydrocarbons.

In one embodiment of the present invention, the third gaseous stream of step (d) is compressed and combined with the first gaseous stream of step (b) prior to step (c). In this way, the feed stream into the high pressure separation vessel has an increased amount of methane or methane enriched gas, providing a greater amount of the second gaseous stream.

The second gaseous stream could subsequently be cooled and/or liquefied, to provide a cooled preferably liquefied hydrocarbon stream such as LNG.

In another aspect of the present invention, there is provided apparatus for treating a hydrocarbon stream such as a natural gas from a feed stream, the apparatus at least comprising:

a first separation vessel having an inlet for the feed stream, a first outlet for a first gaseous stream and second outlet for a first liquid stream;

a high pressure separation vessel having an inlet for the first gaseous stream whose pressure is maintained at ±10 bar, and a first outlet for a second gaseous stream and a second outlet for a second liquid stream; and a stabilizer column having a first inlet for the first liquid stream and a second inlet for the second liquid stream, and a first outlet for a third gaseous stream and a second outlet for a stabilized condensate.

The apparatus of the present invention is suitable for performing the method of the present invention.

Preferably the apparatus also comprises a liquefaction system or unit for liquefying the second gaseous stream obtained at the first outlet of the high pressure separation vessel, the liquefaction unit comprising at least one cryogenic heat exchanger.

An embodiment of the present invention will now be described by way of example only, and with reference to the accompanying non-limiting drawing, FIG. 1, which is a general scheme of part of an LNG plant according to one embodiment of the present invention.

FIG. 1 shows a scheme for treating a hydrocarbon feed stream 10, preferably a natural gas feed stream, having a relatively high pressure, such as above 40 bar, preferably above 50 bar. In addition to methane, a natural gas stream usually contains various amounts of ethane, propane and heavier hydrocarbons. The composition varies depending upon the type and location of the gas. It is usually desirable to separate a natural gas stream into its various hydrocarbon components. Ethane, propane and butane can be used as refrigerants for the natural gas liquefaction, or possibly fuel gas or LPG products. Pentanes and heavier hydrocarbons are usually separated to provide condensates, which are valuable commercial products in their own right.

Optionally, the feed stream 10 is pre-treated such that one or more substances or compounds, such as sulfur, sulfur compounds, carbon dioxide, and moisture or water, are reduced, preferably wholly or substantially removed, as is known in the art.

Following any pre-treatment, the feed stream 10 containing natural gas is passed through inlet 42 into a first separation vessel 12, being for example a gas/liquid separator. Preferably, the feed stream 10 is partially condensed prior to reaching the first separation vessel 12.

In the first separation vessel 12, the feed stream 10 is separated into a first gaseous stream 20 (removed at first outlet 44), generally being a methane-enriched stream, and a first liquid stream 30 (removed at outlet 46), generally being a heavier hydrocarbon rich stream. The first gaseous stream 20 generally has a lower average molecular weight than the feed stream 10, and the first liquid stream 30 generally has a heavier average molecular weight than the feed stream 10.

The first gaseous stream 20 is then fed towards to a high pressure separation vessel 14. Along this route, the first gaseous stream 20 may be treated, for example by one or more treatment units 24, for the removal of one or more components, such as sulfur, sulfur compounds, carbon dioxide, moisture or water, to provide a treated first gaseous stream **20*a*. This maybe as an alternative or an addition to any pre-treatment of the feed stream 10** as mentioned above.

The pressure of the first gaseous stream 20/**20*a* is maintained within ±10 bar of the pressure of the feed stream 10**.

The first gaseous stream 20/**20*a* may also be cooled prior to feeding into the high pressure separation vessel 14. Cooling can be carried out by any method or manner known in the art. As an example, the first gaseous stream 20/20*a* is cooled by passing it through a heat exchanger 25, cooling for which could be provided by a refrigerant circuit 25*a***, and/or air or water cooling.

The high pressure separator vessel 14 is preferably a distillation or scrub column. Its operation is known in the art, and preferably it operates at a pressure >40 bar, such as between 45-70 bar.

In the high pressure separation vessel 14, the first gaseous stream **20*a* (introduced via inlet 52) is separated into a second gaseous stream 40 (removed at first outlet 54), generally being a further methane enriched stream, and a second liquid stream 80 (removed at second outlet 56), generally being a heavier hydrocarbon rich stream. The second liquid stream 80** may generally still include a proportion of methane, as well as heavier hydrocarbons, including some or all of $C_{2-8}$ hydrocarbons.

The second gaseous stream 40 is then preferably liquefied by cooling against one or more refrigerants **26*a*, for example by or in a liquefaction system 26, to create a liquefied stream 50 such as LNG. The liquefying can involve one or more cooling and/or liquefying stages, such as a pre-cooling stage and a main cooling stage, to produce a liquefied natural gas. Optionally, there is a minor liquid recycling stream 90 from the liquefaction system 26 back into the high pressure separation vessel 14**.

Preferably, more than 85 wt % of the hydrocarbon feed stream such as natural gas is liquefied, and the remainder is wholly or substantially (preferably >85 mol %, or >90 mol %, or >95 mol %, or even >99 mol %) a $C_5$+ stabilized condensate product stream. In this way, the invention provides a liquefied hydrocarbon stream such as LNG, and a $C_5$+ stabilized condensate, only.

The first liquid stream 30, generally comprising a mixture of $C_{1-8}$+ hydrocarbons, is preferably expanded or otherwise let down in pressure, such as by being passed through a valve 32, and then fed via first inlet 62 into a stabilizer column 16, preferably being a stabilizing column known in the art. The stabilizer column 16 could run at a pressure of for example below 25 bar, such as 1-20 bar, preferably at or about 10-15 bar pressure.

In the stabilizer column 16, the first liquid stream 30 is separated into a third gaseous stream 60 (removed at first outlet 64) and a stabilized condensate 70 (removed at second outlet 66). The stabilized condensate 70 substantially comprises $C_4$+ hydrocarbons. A minor proportion (especially the $C_4$ components) of the stabilized condensate 70 are preferably recycled back into the stabilizer column 16 as stream 70*a* from a reboiler 34 in a manner known in the art. The remaining stream 70*b* from the reboiler 32 is a $C_5$+ stabilized condensate having a vapour pressure less than 1 bar at 25° C., which can then be cooled by a cooler 36 to provide a cooled product stream 70*c*. The stabilized condensate 70 can be used to provide one or more natural gas liquids in a manner known in the art.

Preferably, the third gaseous stream 60 is compressed by a first compressor 22, to create a compressed third gaseous stream 60*a*, which is then combined with the first gaseous stream 20, normally in advance of any treatment and/or cooling of the first gaseous stream 20.

One or more of the lines for the streams described herein may include a valve such as those shown for the first liquid stream and the second liquid stream 30, 80.

In the scheme shown in FIG. 1, the second liquid stream 80 bottom product of the high pressure separation vessel 14 is also fed into the stabilizer column 16 (preferably with pressure reduction or let down such as via a valve 38) through a second inlet 68, which can be higher or preferably lower than the first inlet 62. This arrangement avoids the need for any separate facilities and processing of a heavy hydrocarbon stream created by a scrub column. In the present invention, the need for a separate fractionation unit or column is avoided by the use of the stabilizer column 16, which is commonly already involved in a liquefying natural gas plant.

Moreover, the present invention increases the separation of methane from natural gas, thus providing an increased enriched methane stream for liquefying into LNG. There is enrichment of the methane stream by the first separation vessel 12 and the high pressure separation vessel 14, and in addition the recycling of the second liquid stream 80, which usually still contains some methane, allows that methane to be partly, substantially or wholly separated from the other hydrocarbon components in the stabilized condensate 70 and combined with the first gaseous stream 20.

In this way, the present invention is able to liquefy over 90 wt % of methane in the original natural gas feed stream 10, and the only subsidiary product is a $C_5$+ stream. Generally, the stabilized condensate of step (d) is wholly or substantially (>85 mol %, or >90 mol %) $C_5$+ hydrocarbons, which can be used to provide condensates, such as pentane, hexane, etc.

Table I gives an overview of the pressures and temperatures of streams at various parts in the example of FIG. 1.

TABLE I

| Line | Temperature (° C.) | Pressure (bar) | Flowrate (kg-mol/sec) | Phase |
|---|---|---|---|---|
| 10 | 45.0 | 70.0 | 5.60 | Mixed |
| 20 | 44.8 | 69.5 | 5.31 | Vapor |

TABLE I-continued

| Line | Temperature (° C.) | Pressure (bar) | Flowrate (kg-mol/sec) | Phase |
|---|---|---|---|---|
| 20a | 19.6 | 65.1 | 5.32 | Mixed |
| 30 | 44.8 | 69.5 | 0.17 | Liquid |
| 40 | −22.5 | 64.3 | 5.59 | Vapor |
| 50 | −163.0 | 1.0 | 4.79 | Mixed |
| 60 | 43.1 | 15.0 | 0.10 | Vapor |
| 70a | 232.8 | 15.1 | 0.07 | Vapor |
| 70b | 232.8 | 15.1 | 0.14 | Liquid |
| 70c | 45.0 | 14.1 | 0.14 | Liquid |
| 80 | 6.7 | 64.4 | 0.07 | Liquid |

As a comparison, the same line-up as FIG. 1 was used, but in contrast to the present invention, the second liquid stream 80 was sent to a separate debutanizer column and not to the stabilizer column 16. The figures for this arrangement are given in Table 2 below.

It can be seen that the flow along line 20*a* is increased in Table 1 by the increase of the flow along line 60. There are also more C5+ condensates along line 70*b* in Table 1, which condensates are a valuable product of liquefaction plants in general. Thus, the flow of lines 40 and 70*b*, the two product lines of the scheme in FIG. 1, are increased by the method of the present invention. The present invention also requires less equipment compared with the second liquid stream in line 80 passing to a separate column.

TABLE II

| Line | Temperature (° C.) | Pressure (bar) | Flowrate (kg-mol/sec) | Phase |
|---|---|---|---|---|
| 10 | 45.00 | 70.00 | 5.60 | Mixed |
| 20 | 44.85 | 69.50 | 5.31 | Vapor |
| 20a | 19.59 | 65.10 | 5.30 | Mixed |
| 30 | 44.85 | 69.50 | 0.17 | Liquid |
| 40 | −22.96 | 64.35 | 5.52 | Vapor |
| 50 | −163.04 | 1.05 | 4.8 | Mixed |
| 60 | 57.50 | 15.00 | 0.06 | Vapor |
| 70 | 45.00 | 14.64 | 0.11 | Liquid |
| 80 | −17.87 | 64.42 | 0.07 | Liquid |

Table III below provides some compositional data for various streams in the example of FIG. 1.

The person skilled in the art will readily understand that many modifications may be made without departing from the scope of the invention. As an example, any compressors may comprise two or more compression stages. Further, any heat exchanger may comprise a train of heat exchangers.

The person skilled in the art will also understand that the present invention can be carried out in many various ways without departing from the scope of the appended claims.

TABLE III

| | Line | | | | | | | | | |
|---|---|---|---|---|---|---|---|---|---|---|
| Composition (mol %) | 10 | 20 | 30 | 40 | 50 | 60 | 70a | 70b | 70c | 80 |
| $H_2O$ | 2.35% | 0.14% | 0.20% | 0.00% | 0.00% | 0.34% | 0.02% | 0.00% | 0.00% | 0.00% |
| $N_2$ | 2.91% | 3.06% | 0.31% | 2.94% | 0.82% | 0.83% | 0.00% | 0.00% | 0.00% | 0.41% |
| $H_2S$ | 0.00% | 0.00% | 0.00% | 0.00% | 0.00% | 0.00% | 0.00% | 0.00% | 0.00% | 0.00% |
| $CO_2$ | 0.30% | 0.31% | 0.17% | 0.01% | 0.01% | 0.29% | 0.01% | 0.00% | 0.00% | 0.00% |
| METHANE | 87.64% | 91.70% | 24.76% | 90.74% | 94.28% | 67.37% | 0.26% | 0.02% | 0.02% | 34.10% |
| ETHANE | 2.29% | 2.34% | 2.28% | 2.70% | 2.66% | 6.99% | 0.32% | 0.04% | 0.04% | 4.28% |
| PROPANE | 1.39% | 1.35% | 3.50% | 2.13% | 1.59% | 13.00% | 4.76% | 0.91% | 0.91% | 11.24% |
| IBUTANE | 0.27% | 0.25% | 1.21% | 0.48% | 0.25% | 3.06% | 8.90% | 2.30% | 2.30% | 5.82% |
| BUTANE | 0.55% | 0.48% | 3.08% | 0.89% | 0.38% | 5.65% | 28.73% | 8.53% | 8.53% | 17.09% |
| IPENTANE | 0.20% | 0.16% | 1.91% | 0.08% | 0.02% | 1.38% | 17.43% | 7.24% | 7.24% | 11.51% |
| PENTANE | 0.20% | 0.14% | 2.24% | 0.03% | 0.01% | 1.05% | 17.73% | 7.70% | 7.70% | 11.23% |
| $C_6$+ | 1.89% | 0.06% | 60.34% | 0.00% | 0.00% | 0.03% | 21.86% | 73.27% | 73.27% | 4.31% |

The invention claimed is:

1. A method of treating a hydrocarbon stream comprising at least the steps of:

(a) providing a hydrocarbon feed stream;

(b) passing the feed stream through a first separation vessel to provide a first gaseous stream and a first liquid stream;

(c) passing the first gaseous stream from step (b) through a high pressure separation vessel to provide a second gaseous stream and a second liquid stream;

(d) maintaining the pressure of the first gaseous stream between step (b) and step (c) within ±10 bar;

(e) passing the first liquid stream of step (b) through a stabilizer column to provide a third gaseous stream and a stabilized condensate;

(f) feeding the second liquid stream from step (c) into the stabilizer column;

(g) liquefying the second gaseous stream in a liquefaction system, thereby obtaining a liquefied hydrocarbon stream; and (h) feeding a liquid recycling stream from the liquefaction system back into the high pressure separation vessel.

2. The method according to claim 1, wherein the third gaseous stream of step (e) is compressed and combined with the first gaseous stream.

3. The method according to claim 2, wherein the first gaseous stream of step (b) is cooled prior to step (c).

4. The method according to claim 2, wherein prior to step (c) the first gaseous stream is treated for the reduction of one or more of the group consisting of: sulfur, sulfur compounds, carbon dioxide, moisture or water.

5. The method according to claim 1, wherein the first gaseous stream of step (b) is cooled prior to step (c).

6. The method according to claim 1, wherein prior to step (c) the first gaseous stream is treated for the reduction of one or more of the group consisting of:

sulfur, sulfur compounds, carbon dioxide, moisture or water.

7. The method according to claim 1, wherein the stabilized condensate of step (e) is greater than 85 mol % $C_5$+hydrocarbons.

8. The method according to claim 1, wherein the only byproduct of the method is the stabilized condensate.

9. The method according to claim 1, wherein more than 85 wt % of the feed stream is liquefied.

10. The method according to claim 1, wherein the stabilized condensate of step (e) is greater than 90 mol % $C_5$+hydrocarbons.

11. The method according to claim 1, wherein said hydrocarbon stream is natural gas.

12. The method according to claim 1, wherein said liquefied hydrocarbon stream is LNG.

13. The method according to claim 1, wherein said hydrocarbon stream is natural gas and said liquefied hydrocarbon stream is LNG.

14. The method according to claim 1, wherein said liquefying of the second gaseous stream in step (g) is performed by cooling against at least one refrigerant in the liquefaction system.

15. The method according to claim 1, wherein said stabilized condensate is a $C_4$ and $C_5$+stream, having a vapour pressure less than 1 bar at ambient pressure and temperature.

16. Apparatus for treating a hydrocarbon stream from a feed stream, the apparatus at least comprising:

a first separation vessel having an inlet for the feed stream, a first outlet for a first gaseous stream and second outlet for a first liquid stream;

a high pressure separation vessel having an inlet for the first gaseous stream whose pressure is maintained at ±10 bar, and a first outlet for a second gaseous stream and a second outlet for a second liquid stream;

a stabilizer column having a first inlet for the first liquid stream and a second inlet for the second liquid stream, and a first outlet for a third gaseous stream and second outlet for a stabilized condensate;

a liquefaction system for liquefying the second gaseous stream; and a recycling stream from the liquefaction system back into the high pressure separation vessel.

17. The apparatus as claimed in claim 16, wherein the third gaseous stream from the stabilizer column is connected to the first gaseous stream of the first separation vessel.

18. The apparatus according to claim 16, wherein said stabilized condensate is a $C_4$ and $C_5$+stream, having a vapour pressure less than 1 bar at ambient pressure and temperature.

19. The apparatus according to claim 16, wherein the liquefying system comprises at least one refrigerant.

* * * * *